US008109730B2

(12) United States Patent
Andersson

(10) Patent No.: US 8,109,730 B2
(45) Date of Patent: Feb. 7, 2012

(54) PUMP FOR CONTAMINATED LIQUID

(75) Inventor: Patrik Andersson, Skogås (SE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 867 days.

(21) Appl. No.: 11/917,867

(22) PCT Filed: Jun. 5, 2006

(86) PCT No.: PCT/SE2006/000663

§ 371 (c)(1),
(2), (4) Date: Jul. 23, 2008

(87) PCT Pub. No.: WO2006/135304

PCT Pub. Date: Dec. 21, 2006

(65) Prior Publication Data

US 2009/0169365 A1 Jul. 2, 2009

(30) Foreign Application Priority Data

Jun. 17, 2005 (SE) ..... 0501382

(51) Int. Cl.
*B63H 11/00* (2006.01)

(52) U.S. Cl. ..... 416/180; 416/182; 416/188; 416/192; 416/231 R; 415/121.1

(58) Field of Classification Search ..... 415/121.1; 416/176, 180, 182, 183, 188, 192, 231 R, 416/231 B, 235
See application file for complete search history.

(56) References Cited

U.S. PATENT DOCUMENTS

| | | | | |
|---|---|---|---|---|
| 4,478,550 | A | 10/1984 | Watanabe et al. | |
| 4,640,666 | A * | 2/1987 | Sodergard | 415/121.1 |
| 6,190,121 | B1 * | 2/2001 | Hayward et al. | 415/121.1 |
| 2003/0215331 | A1 * | 11/2003 | Andersson | 415/206 |
| 2009/0022582 | A1 * | 1/2009 | Andersson | 415/170.1 |
| 2009/0092479 | A1 * | 4/2009 | Wagner | 415/121.1 |

FOREIGN PATENT DOCUMENTS

| | | | |
|---|---|---|---|
| DE | 1528694 | | 3/1969 |
| DE | 19834815 | A1 | 2/2000 |
| EP | 1357294 | A2 | 10/2003 |
| GB | 1125376 | | 8/1968 |
| JP | 58195094 | A | 11/1983 |

* cited by examiner

*Primary Examiner* — Ajay K Arora
(74) *Attorney, Agent, or Firm* — Browdy and Neimark, PLLC

(57) ABSTRACT

The invention relates to a pump for pumping contaminated liquid including solid matter, comprising a pump housing provided with a rotatable impeller (3) having at least one vane (9) and an impeller seat (4), the impeller seat (4) presenting at least one recess (13) in the top surface (11) thereof, a shearing/cutting action arising between an cutting edge (15) of said recess (13) and a lower edge (14) of the vane (9) as the impeller (3) rotates relative to the impeller seat (4). Furthermore, the pump also comprises means for guiding the solid matter towards said recess (13), the guiding means comprising at least one guide in and at least one projection (20), an upper surface (19) of the guide pin extending from a position contiguous to the most inner part of the vane (9) of the impeller (3) towards the impeller seat (4), and the projection (20) protruding from the impeller seat (4).

19 Claims, 3 Drawing Sheets

PUMP FOR CONTAMINATED LIQUID

TECHNICAL FIELD OF THE INVENTION

The present invention relates generally to the field of pumps for sewage or waste water, and more specifically to a pump for pumping unscreened contaminated liquid including solid matter, such as plastic materials, hygiene articles, textile, rags, etc. The present invention also relates to pumps, the purpose of which is to provide a uniform sludge from out of a raw material, such as slaughterhouse waste from a fish farming. More precisely, not necessarily counteract clogging of the pump, but instead cutting up the solid matter/raw material into pieces more adapted for subsequent manufacturing steps. Said pump comprises a pump housing provided with a rotatable impeller having at least one vane, and an impeller seat, the impeller seat presenting at least one recess in the top surface thereof, a sheering/cutting action arising between an cutting edge of said recess and a lower edge of the vane as the impeller rotates relative to the impeller seat.

BACKGROUND OF THE INVENTION

In sewage stations, septic tanks, wells, etc., it often occurs that solid matter or pollutants, such as socks, sanitary pads, paper, etc., clogs the submergible pump that is lowered into the basin of the system. The contaminations stick to the vanes of the impeller and become wound around the impeller.

In order to get rid of the clogging matter, it is known to equip centrifugal pumps with means for cutting up the solid matter. More precisely, the solid matter is cut up in smaller pieces between the vane of the impeller and a recess in the impeller seat of the pump housing, as is seen in for example DE 198,34,815 or U.S. Pat. No. 5,516,261. In each of the two referred documents it is just briefly shown how merely the edge between the leading edge of the vane and the tip of the surface of the vane of the impeller interacts with said recess. It is shown how said edge of the vane meets the cutting edge of the recess in a direction parallel to the direction of rotation of the impeller. More precisely, both cutting edges are perpendicular to the direction of rotation of the impeller. In these cases a superfluously high force, and thereby also a lot of energy, is needed to cut up the solid matter into smaller pieces.

If the solid matter is not cut up sufficiently efficiently into discrete pieces, but the pieces has long uncut fibers still connecting them to each other, the solid matter might clog the pump in an even more severe way. If the solid matter is semi-cut, as described, some pieces will get caught between the impeller and the pump housing and some pieces will still be to large to pass from the basin side of the impeller past the impeller. Thus, this will make the rotation of the impeller heavy and the energy consumption will increase. In a worst case scenario, the impeller will get totally jammed and thus the pump may get seriously damaged. Such an unintentional shutdown is costly, due to expensive and cumbersome and unplanned maintenance work.

DE 1,528,694 shows a pump comprising an impeller seat presenting a number of recesses of different shape and orientation, which in conjunction with the impeller improves the cutting action. Nevertheless, solid matter having long fibers is still a problem as the fibers may get tangled among the vanes of the impeller, resulting in a gradual decrease of the efficiency of the pump.

Another way of accomplishing the cutting up of the solid matter is shown in U.S. Pat. No. 3,096,718. Contrary to recesses, said document shows an impeller seat presenting a cutting blade, which has a sharp edge facing the vanes of the impeller and which in conjunction with said vanes cuts up the solid matter.

GB 1,125,376 and U.S. Pat. No. 5,516,261 shows a number of grooves extending in a spiral shape from a centrally located open channel in the impeller seat to the periphery thereof. The function of the grooves is, in conjunction with the vanes of the impeller, to transport the cut up pieces towards the outer wall of the pump housing and further out of the pump together with the pumped liquid. In order to ensure a proper function of the grooves, the solid matter has to be cut up into discrete pieces. Otherwise, if long fibers are uncut and connecting different pieces of solid matter, the pieces may be transported in different directions from the center of the impeller seat which may aggravate the clogging of the impeller.

From U.S. Pat. No. 3,128,051 it appears that instead of separate recesses for the cutting up of the solid matter and separate grooves for the transportation of the cut up pieces away from and past the impeller, it is possible to combine the two functions in a single element, which both presents the cutting edge of the recess and the transporting shape of the groove.

None of the abovementioned suggestions presents solutions to the drawbacks, or discuss the problems at all, related to the ability to cut long fibers.

EP 1,357,294 directed to the applicant, shows a pump which is exposed for solid matter included in unscreened sewage water, but which is not designed to cut up said solid matter. Instead the pump has a groove in the impeller seat for transportation of the entire contaminating subject towards the periphery of the pump housing. Further, the pump has a guide pin, the upper surface of which extends all the way from the surface of the impeller seat to the center of the impeller, and the function of which is to extend the function of the groove towards the center of an open channel in the impeller seat. Thus, there are no indications howsoever on how to ensure reliable cutting up of solid matter having long fibers.

Furthermore, submergible pumps are used to pump fluid from basins that are hard to get access to for maintenance and the pumps often operate for long periods of time, not infrequently up to 12 hours a day or more. Therefore it is highly desirable to provide a pump having long durability.

SUMMARY OF THE INVENTION

The present invention aims at obviating the afore-mentioned disadvantages of previously known pumps, and at providing an improved pump. A primary object of the present invention is to provide an improved pump of the initially defined kind with respect to the efficiency of the cutting up of the solid matter and the energy needed therefore. It is another object of the present invention to provide a pump that in a reliable way manages to cut up solid matter having long fibers. It is yet another object of the present invention to provide a pump having an improved durability, thanks to the decreased energy consumption upon cutting. Yet another object of the present invention is to provide a pump, which easily may be altered to suit changed conditions in which the pump operates.

According to the invention at least the primary object is attained by means of the initially defined pump having the features defined in the independent claim. Preferred embodiments of the present invention are further defined in the dependent claims.

According to the present invention, there is provided a pump of the initially defined type, which is characterized in that the pump also comprises means for guiding the solid matter towards said recess, the guiding means comprising at least one guide pin and at least one projection, an upper surface of the guide pin extending from a position contiguous to the most inner part of the vane of the impeller towards the impeller seat, and the projection protruding from the impeller seat.

Thus, the present invention is based on the insight of the importance of guiding the solid matter towards the cutting means of the impeller seat in order to avoid long fibers getting tangled around the vanes of the impeller.

In a preferred embodiment of the present invention, the main cutting edge of the recess is located in a position radially distanced from the open channel and generally in parallel with the direction of rotation of the impeller. This means that the shearing/cutting forces, that arise as the lower edge of the vane passes the main cutting edge of the vane, is reduced.

According to a preferred embodiment, the impeller seat is constituted of a replaceable insert. Then the ability to alter the pump to suit changed conditions, as a consequence of the season and the type of area from which the water emanates, is considerably increased. Different inserts may have different number of grooves, recesses, projections, etc., and/or the shape of the grooves, recesses, projections, etc., may be altered to suit different pollutants having different structure. In addition, also the impeller may be replaced by another impeller having different number of vanes and/or different shape of the vanes.

BRIEF DESCRIPTION OF THE DRAWINGS

A more complete understanding of the above-mentioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
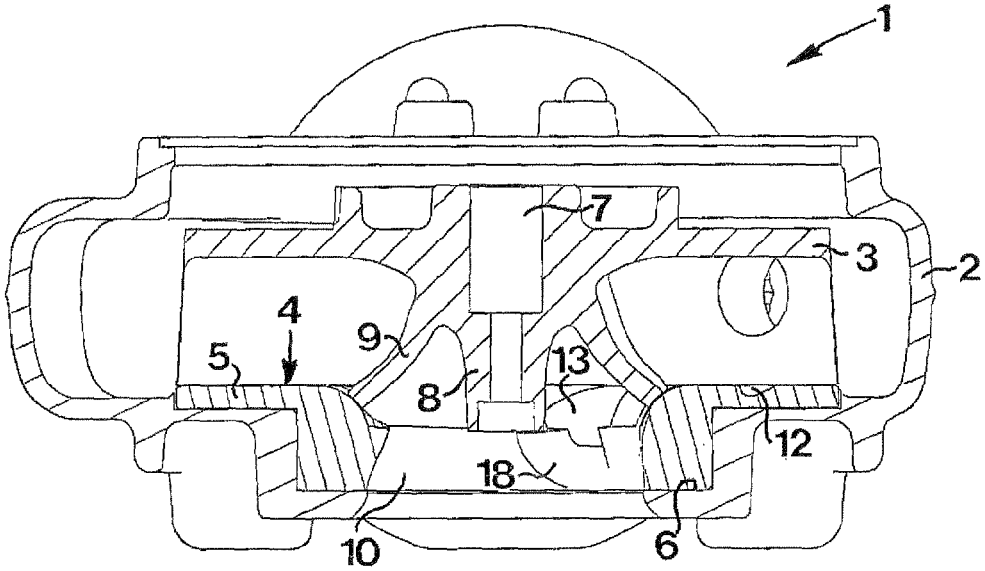
FIG. 1 is a cross sectional view of a pump according to the invention.

FIG. 1 shows a pump 1 according to the invention (some parts are removed, such as the engine and an upper case). The invention relates to pumps in general, but in the described embodiment the pump is constituted by a submergible centrifugal pump.

The pump 1 comprises a pump housing 2 provided with an impeller 3 and an impeller seat 4. In a preferred embodiment of the present invention the impeller seat 4 is constituted by an insert 5 releasably connected to the pump housing 2 by being located in a seat 6 in the pump housing 2 in such a way that the insert cannot rotate relative to the pump housing 2. The impeller 3 is rotatable in the pump housing 2 and is suspended in a drive shaft (not shown) extending from above and inserted in a hole 7, in a centrally located hub 8 of the impeller 3, and secured by means of a screw (not shown) extending from below through the hub 8.

Figure 2:
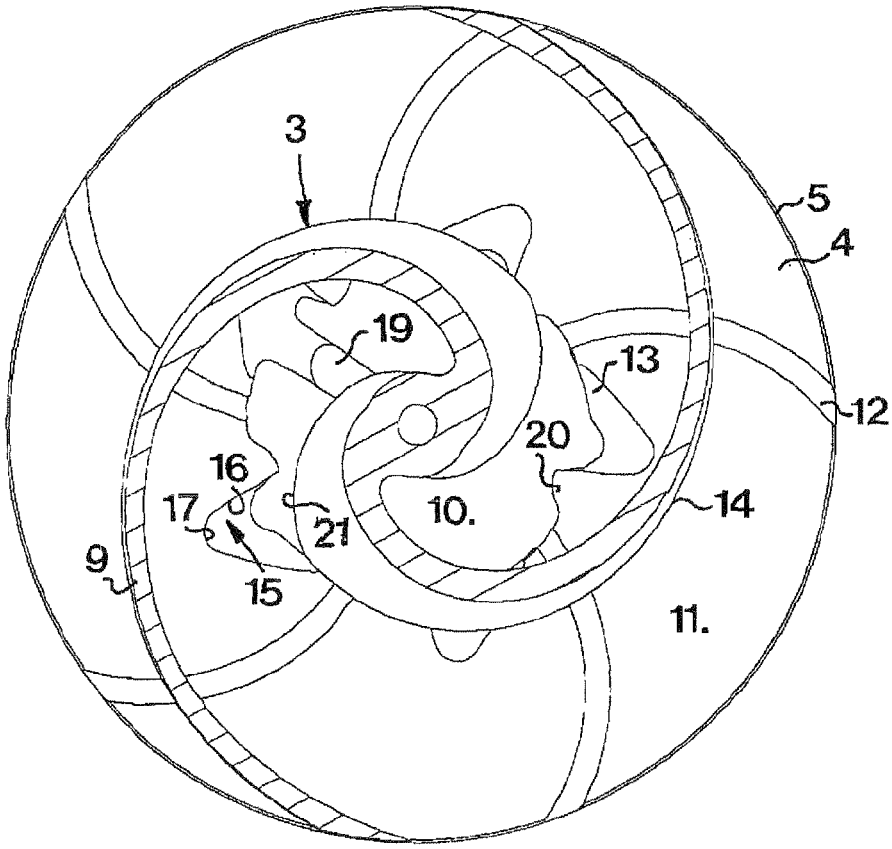
FIG. 2 is a top view of an impeller and an insert, the impeller being sectioned.
Figure 3:
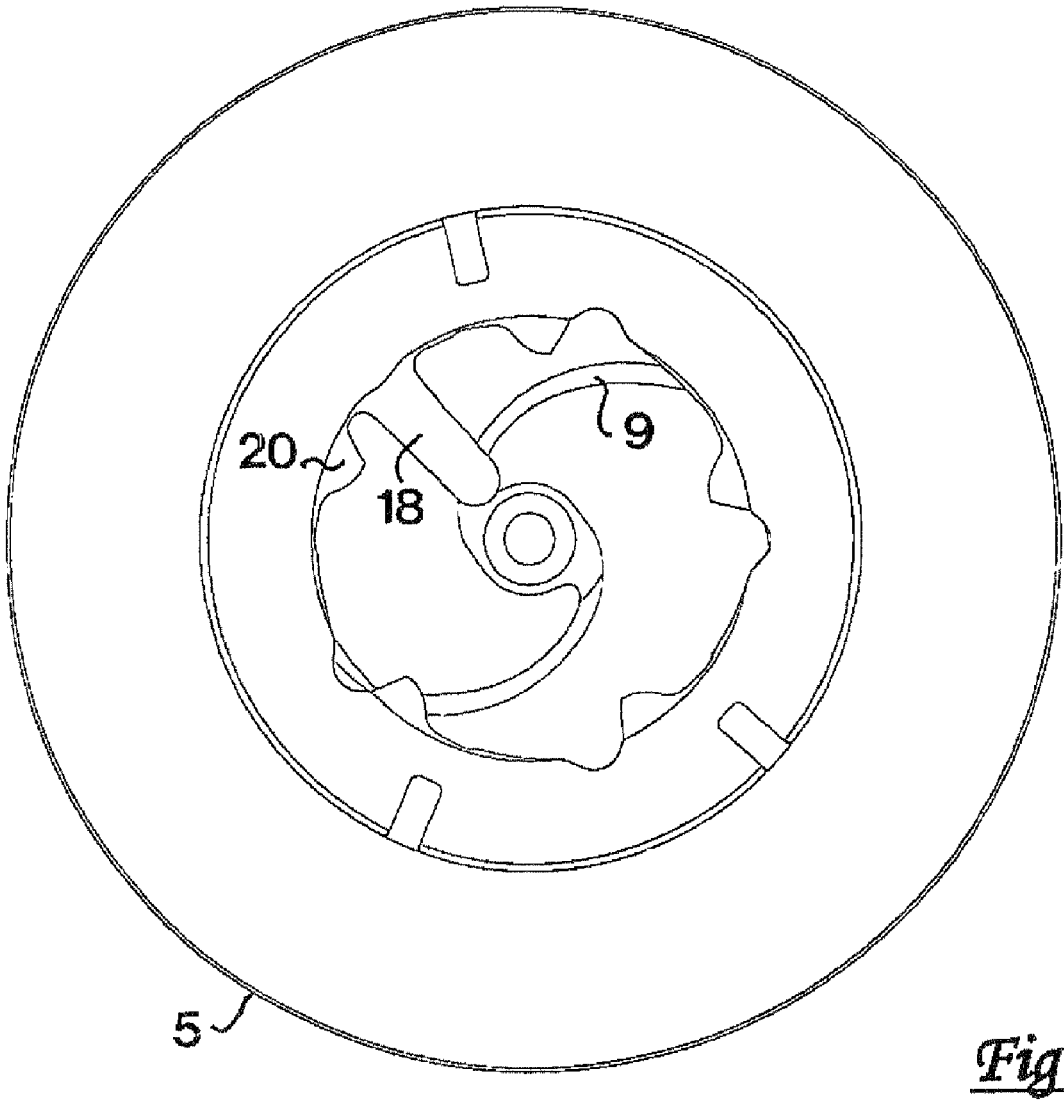
FIG. 3 is a bottom view of the impeller and the insert.
Figure 4:
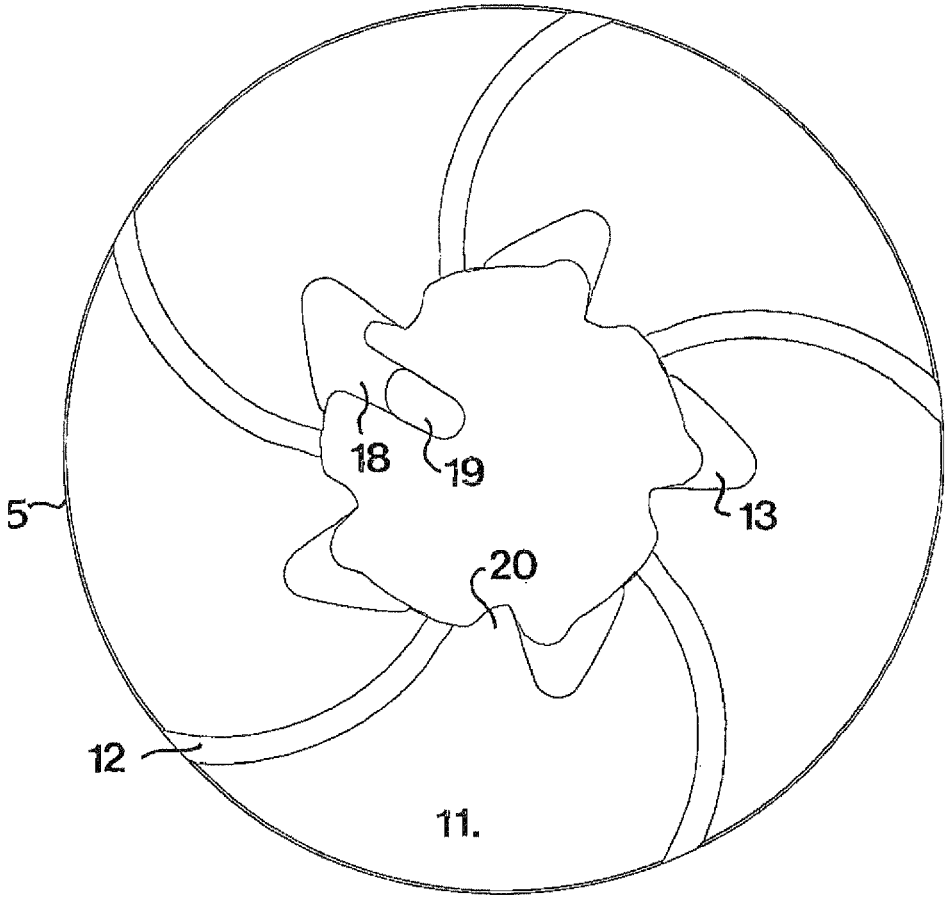
FIG. 4 is a top view of the insert.

Reference is now made to FIG. 2 as well. The impeller 3 has at least one vane 9 extending from the hub 8 towards the periphery of the impeller 3. Preferably the vane 9 extends in a spiral shape. The direction of rotation of the impeller 3 is clockwise in the embodiment shown in FIG. 2, and the vanes 9 are extending in the opposite direction, i.e. counter clockwise. In the shown embodiment the impeller 3 has two vanes 9, each extending approximately 360 degrees around the hub 8, but it shall be pointed out that the number of vanes 9 and the length of the vanes 9 may vary greatly, in order to suit different liquids and applications.

Figure 5:
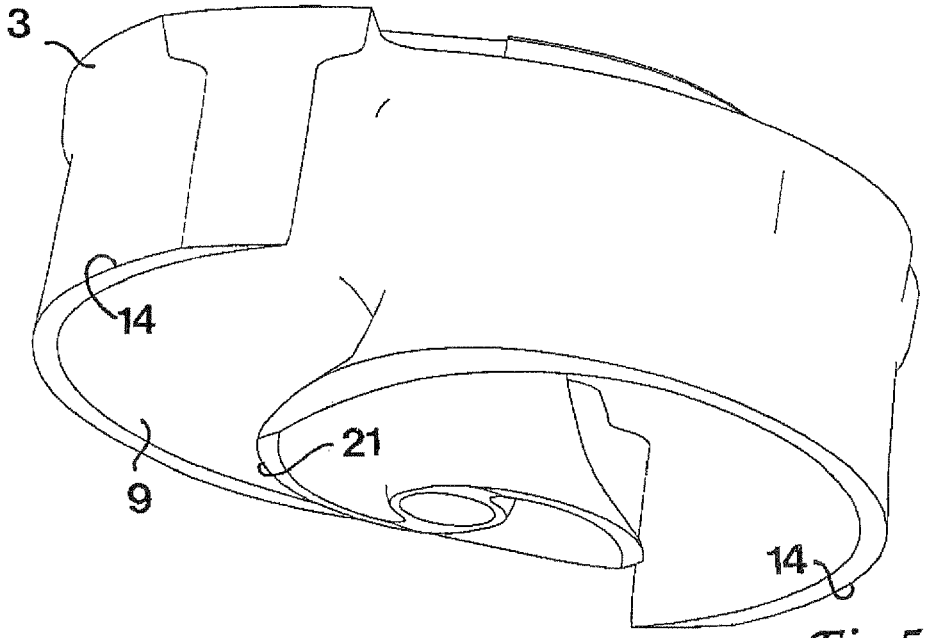
FIG. 5 is a perspective view from below of the impeller.

The insert 5 or the impeller seat 4 has a centrally located open channel 10 and a top surface 11. For the sake of simplicity the term "top surface" as used in the description as well as in the claims means the entire surface of the insert 5 facing the liquid during operation, i.e. both the part contiguous to the open channel 10 and the part facing upwards. The impeller seat 4 preferably presents at least one groove 12 in the top surface 11, the groove 12 extending from the open channel 10 towards the periphery of the impeller seat 4. Preferably the groove 12 extends in a spiral shape in an opposite direction relative to the one of the vanes 9. The number of grooves 12 and their shape and orientation may vary greatly, in order to suit different liquids and applications. The function of the groove 12 is to guide the cut up pieces outwards to the periphery of the pump housing. As the solid matter is being cut up, sludge from the solid matter will fasten underneath the vanes 9 of the impeller 3 and slow down the rotating motion of the impeller 3 and even stop the same. But the groove 12 contribute to keep the vanes 9 clean, by scraping of the sludge each time the vane 9 passes the same. Furthermore, the impeller seat 4 presents at least one recess 13. The function of the recess 13 is, in conjunction with the vanes 9 of the impeller 3, to cut up the solid matter included in the liquid being pumped. The vanes 9 of the impeller 3 sweeps across as the impeller 3 rotates and each time a vane 9 sweep past a recess 13 a decreasing flow area through the recess 13 arises. A cutting edge 15 of the recess 13 is made up of two major parts, a first part 16 extending generally in a radial direction in relation to the impeller seat 11 and a second part 17, or main cutting edge, slightly arch shaped and extending generally in parallel with the direction of rotation of the impeller 3. As the vane 9 sweeps across the recess 13, a lower edge 14 of the vane 9 moves or passes in an angle relative to the cutting edge 15 of the recess 13. More precisely, the solid matter experience a cutting motion as well as a sheering motion. The vane 9 reaches the main cutting edge 17 in a direction from inside and out of the impeller seat 4, which in an energy consumption point of view is a lot better than previously known designs. As may be seen in FIG. 2 each of the two vanes 9 is in engagement with one recess 13 at a time, and the two vanes 9 are out of phase in relation to each other with regard to their passing of the recesses 13, resulting in a low energy consumption. The shape of the lower edge 14, also known as the tip of the surface, of the vane 9 corresponds, in the axial direction, to the shape of the top surface 11 of the impeller seat 4. The axial distance between the lower edge 14 and the top surface ought to be less than 1 mm in order to get a well defined sheering/cutting action between the lower edge 14 of the vane 9 and the cutting edge 15 of the recess 13. Preferably said distance is less than 0.7 mm and most preferably less than 0.5 mm. At the same time said distance shall be more than 0.1 mm and preferably more than 0.3 mm. If the impeller 3 and the impeller seat 4 are to close to each other a frictional force or a breaking force acts on the vanes 9 of the impeller 3. The edge of the vanes 9 contiguous to the hub 8 is the leading edge 21 of the vane 9 (see FIG. 5). Preferably the leading edge 21 of the vane 9 changes to become the lower edge 14 of the vane 9 at a sharp edge. The leading edge 21 is, in the shown embodiment, located directly above the open channel 10 of the impeller seat 4 and the lower edge 14 of the vane 9 is located directly above the top surface 11 of the impeller seat 4.

It is a well known problem that solid matter having long fibers tends to get tangled among the vanes 9 of the impeller 3 and winded around the hub 8 of the impeller 3. In order to ensure that the pump 1 does not get clogged it is provided with means for guiding the solid matter towards the recess 13. The guiding means comprises at least one guide pin 18 extending from the top surface 11 of the impeller seat 4, more precisely from the part of the top surface 11 facing the open channel 10. The guide pin 18 extends generally in the radial direction of the impeller seat 4 and is located below the impeller 3 and presents an upper surface 19, which extends from a position contiguous to the most inner part of the vane 9 of the impeller 3 towards the top surface 11 of the impeller seat 4. More precisely, the most inner part of the upper surface 19 of the guide pin 18 is located at approximately the same radial distance from the center of the impeller 3 as the most inner part of the vane 9 of the impeller 3. Preferably the upper surface 19 of the guide pin 18 terminates at a distance from the top surface 11 of the impeller seat 4. If the upper surface 19 of the guide pin 18 should reach all the way out to the top surface 11 of the impeller seat 4 it would guide all the clogging matter towards merely one recess 13 and that would only aggravate the clogging of the pump 1, which might then get totally jammed. The axial distance between the upper surface 19 of the guide pin 18 and the leading edge 21 of the vane 9 ought to be less than 1 mm.

In addition, the guide means also comprises at least one projection 20 extending from top surface 11 of the impeller seat 4, more precisely from the part of the top surface 11 facing the open channel 10. The projection 20 is located below the impeller 3. The axial distance between the projection 20 and the leading edge 21 of the vane 9 ought to be less than 1 mm. Preferably the projection 20 is terminated radially outside of the upper surface 19 of the guide pin 18. As the upper surface 19 of the guide pin 18 terminates radially inside of the projections 20 it will spread the solid matter approximately equally along the top surface 11 facing the open channel 10, and each projection 20 will only guide a part of the solid matter to the corresponding recess 13. The projection 20 is located adjacent to and, in the direction of rotation of the impeller 3, after the interacting recess 13. If long fibers tend to get winded around the hub 8, as the impeller 3 rotates, the upper surface 19 of the guide pin 18 forces the fibers outwards towards the projection 20 and the recesses 13. Thereafter, the solid matter gets caught by the projection 20 and the solid matter is forced outwards into the adjacent recess 13 for subsequent cutting up between the lower edge 14 of the vane 9 and the cutting edge 15 of the recess 13.

Furthermore, it shall be pointed out that the preferred axial distance between, on one hand, the upper surface 19 of the guide pin 18 and the leading edge 21 of the vane 9, and on the other hand, the projection 20 and the leading edge 21 of the vane 9, shall be the same as described above in connection with the axial distance between the top surface 11 of the impeller seat 4 and the lower edge 14 of the vane 9. Furthermore, the upper surface 19 of the guide pin 18 and the projection 20 corresponds to and are located adjacent to the leading edge 21 of the vane 9 of the impeller 3.

Finally, It shall be pointed out that the most preferred number of recesses 13, grooves 12 and projections 20 are all five. Furthermore, the pump 1 shall preferably only comprise one guide pin 18. Otherwise the open channel 10 should be to obstructed, which would adversely affect the function of the pump 1.

FEASIBLE MODIFICATIONS OF THE INVENTION

The invention is not limited only to the embodiments described above and shown in the drawings. Thus, the pump, or more precisely the impeller seat may be modified in all kinds of ways within the scope of the appended claims.

It shall be pointed out that the number of vanes preferably shall be different from, preferably larger than, the number of grooves, and, if it is an even number of vanes, the number of grooves shall be odd. Otherwise disturbances may arise. If for instance, the impeller has two vanes the number of grooves should be three or five.

Furthermore, said impeller must not hang in the drive shaft as mentioned above. Instead the impeller may float over the impeller seat in another suitable way, e.g. by means of bearings or the like.

The invention claimed is:

1. A pump for pumping contaminated liquid including solid matter, comprising a pump housing (2) provided with a rotatable impeller (3) having at least one vane (9) and an impeller seat (4), the impeller seat (4) presenting at least one recess (13) in the top surface (11) thereof, a sheering/cutting action arising between a cutting edge (15) of said recess (13) and a lower edge (14) of the vane (9) as the impeller (3) rotates relative to the impeller seat (4), wherein the pump (1) also comprises means for guiding the solid matter towards said recess (13), the guiding means comprising at least one guide pin (18) and at least one projection (20), an upper surface (19) of the guide pin (18) extending from a position contiguous to the most inner part of the vane (9) of the impeller (3) towards the impeller seat (4), and the projection (20) protruding from the impeller seat (4).

2. A pump according to claim 1, wherein the vane (9) extends in a spiral shape from the center of the impeller (8) to the periphery thereof and the lower edge (14) of which has a shape that corresponds to a top surface (11) of the impeller seat (4).

3. A pump according to claim 1, wherein the impeller seat (4) presents at least one groove (12) in the top surface (11) thereof, which groove (12) extends from a centrally located open channel (10) in the impeller seat (4) to the periphery thereof.

4. A pump according to claim 3, wherein the groove (12) extends in a spiral shape in the opposite direction relative to the spiral shape of the vane (9).

5. A pump according to claim 3, wherein the recess (13) is located adjacent to and open towards the open channel (10) of the impeller seat (4).

6. A pump according to claim 3, wherein a main cutting edge (17) of the recess (13) is located in a position radially distanced from the open channel (10) and generally in parallel with the direction of rotation of the impeller (3), in order to reduce the shearing/cutting forces as the lower edge (14) of the vane (9) passes said edge.

7. A pump according to claim 1, wherein the upper surface (19) of the guide pin (18) is terminated at a distance from the top surface (11) of said impeller seat (4).

8. A pump according to claim 6, wherein the projection (20) is terminated radially outside the upper surface (19) of the guide pin (18).

9. A pump according to claim 1, wherein the at least one projection (20) is located adjacent to and, in the operational direction of rotation of the impeller (3), after said at least one recess (13).

10. A pump according to claim 3, wherein the guide pin (18) and the projection (20) are arranged in the open channel (10) below the impeller (3).

11. A pump according to claim 1 wherein the upper surface (19) of the guide pin (18) and the projection (20) correspond to and are located adjacent to the leading edge (21) of the vane (9) of the impeller (3).

12. A pump according to claim 2, wherein the axial distances between, on one hand, the lower edge (14) of the vane (9) of the impeller (3) and the top surface (11) of the impeller seat (4) and, on the other hand, the leading edge (21) of the vane (9) and the upper surface (19) of the guide pin (18) and the projection (20), are less than 1 mm.

13. A pump according to claim 12, wherein said distances are less than 0.5 mm.

14. A pump according to claim 1, wherein the impeller seat (4) is constituted of an insert (5) releasably connected to the pump housing (2).

15. A pump according to claim 2, wherein the impeller seat (4) presents at least one groove (12) in the top surface (11) thereof, which groove (12) extends from a centrally located open channel (10) in the impeller seat (4) to the periphery thereof.

16. A pump according to claim 15, wherein the upper surface (19) of the guide pin (18) is terminated at a distance from the top surface (11) of said impeller seat (4).

17. A pump according to claim 16 wherein the upper surface (19) of the guide pin (18) and the projection (20) correspond to and are located adjacent to the leading edge (21) of the vane (9) of the impeller (3).

18. A pump according to claim 17, wherein the axial distances between, on one hand, the lower edge (14) of the vane (9) of the impeller (3) and the top surface (11) of the impeller seat (4) and, on the other hand, the leading edge (21) of the vane (9) and the upper surface (19) of the guide pin (18) and the projection (20), are less than 1 mm.

19. A pump according to claim 18, wherein the impeller seat (4) is constituted of an insert (5) releasably connected to the pump housing (2).

* * * * *